US008127734B2

(12) United States Patent
Jolley, Jr.

(10) Patent No.: US 8,127,734 B2
(45) Date of Patent: Mar. 6, 2012

(54) INTERNAL COMBUSTION ENGINE HAVING GUILLOTINE SLIDING VALVE

(76) Inventor: Jack Jolley, Jr., Apalachicola, FL (US)

( * ) Notice: Subject to any disclaimer, the term of this patent is extended or adjusted under 35 U.S.C. 154(b) by 862 days.

(21) Appl. No.: 12/217,979

(22) Filed: Jul. 10, 2008

(65) Prior Publication Data

US 2010/0006054 A1 Jan. 14, 2010

(51) Int. Cl.
*F01L 5/00* (2006.01)
*F01L 7/02* (2006.01)
*F01L 9/04* (2006.01)

(52) U.S. Cl. ..... 123/188.4; 123/81 R; 123/188.5; 123/90.11

(58) Field of Classification Search ..... 123/188.4, 123/81 R, 188.5, 90.11
See application file for complete search history.

(56) References Cited

U.S. PATENT DOCUMENTS 2,028,138 A 1/1936 Coulling
2,113,519 A 4/1938 Sloat
2,686,507 A * 8/1954 Lombardi ..... 123/312
2,874,686 A * 2/1959 Carey, Jr. ..... 123/190.14
4,765,287 A 8/1988 Taylor et al.
4,875,440 A 10/1989 Kaptur
5,542,385 A 8/1996 Kim
5,596,966 A 1/1997 Elder
5,694,890 A 12/1997 Yazdi
6,917,874 B2 * 7/2005 Uchida et al. ..... 701/108
7,137,367 B2 * 11/2006 Tanei ..... 123/90.15
7,263,963 B2 9/2007 Price
7,309,057 B2 * 12/2007 Santiago ..... 251/172
2005/0092952 A1 * 5/2005 McCarroll et al. ..... 251/129.18
2009/0272357 A1 * 11/2009 Yaoita ..... 123/188.4

* cited by examiner

*Primary Examiner* — Noah Kamen
*Assistant Examiner* — Grant Moubry
(74) *Attorney, Agent, or Firm* — J. Wiley Horton

(57) ABSTRACT

An internal combustion engine employing a valve regulating the passage of a fluid between the hollow interior of the combustion chamber and the atmosphere. The valve includes a valve body having a valve opening and a blade track passing around the valve opening. A guillotine blade slides linearly along the blade track between an open position in which said fluid may pass through the valve opening and a closed position in which the fluid is restricted from passing through the valve opening. A reciprocating driver moves the guillotine blade along the blade track when actuated by an electronic control signal.

19 Claims, 4 Drawing Sheets

INTERNAL COMBUSTION ENGINE HAVING GUILLOTINE SLIDING VALVE

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of internal combustion engines. More particularly, the present invention comprises an internal combustion engine having a sliding guillotine valve.

2. Description of the Related Art

Most modern internal combustion engines operating on the Otto cycle (or close derivatives such as the Miller cycle) utilize intake and exhaust valves (1) to allow air to fill the combustion chamber during the intake stroke, (2) to trap air in the combustion chamber during the compression stroke and power stroke, and (3) to evacuate the products of combustion from the combustion chamber during the exhaust stroke. The timing, lift, and duration of valve opening is most commonly controlled by the rotation of a camshaft. The camshaft is mechanically linked to the output shaft of the engine such that each valve operates in synchronization with the engine's combustion cycle.

In order to change the timing or duration of valve opening, one must replace the existing camshaft with a camshaft having a different cam geometry (or utilize complex mechanisms to vary the distance between the camshaft center and the valve stems). Because engines are generally equipped with camshafts having nearly optimal cam geometries, this is not much of a concern in conventional vehicle applications. When one wishes to employ a more aggressive tuning (such as in racing applications) or when one wants to improve fuel economy, having the ability to vary the timing, lift, or duration of valve opening is desirable.

Optimal timing, lift, and duration are functions of engine speed and load. Thus, in order to operate at optimal volumetric efficiency, it is necessary to vary timing, lift, and duration throughout an engine's powerband. It has become increasingly common to utilize multiple intake or exhaust valves on a single combustion chamber or to utilize multiple camshafts or cams to control a single valve. These systems improve volumetric efficiency, but do so at the expense of additional weight, cost, and complexity. Thus, it would be desirable to provide an intake and exhaust valve design which is highly variable such that different timing, lift, and duration may be employed throughout the engine's powerband.

BRIEF SUMMARY OF THE INVENTION

The present invention is an internal combustion engine employing a guillotine sliding valve regulating the passage of a fluid between the hollow interior of the combustion chamber and the atmosphere. The valve includes a valve body having a valve opening and a blade track passing around the valve opening. A guillotine blade slides linearly along the blade track between an open position in which said fluid may pass through the valve opening and a closed position in which the fluid is restricted from passing through the valve opening. A reciprocating driver moves the guillotine blade along the blade track when actuated by an electronic control signal.

REFERENCE NUMERALS IN THE DRAWINGS

| | | | |
|---|---|---|---|
| 10 | powertrain control module | 12 | cable |
| 14 | combustion chamber | 16 | spark plug |
| 18 | reciprocating driver | 20 | connector |
| 22 | blade | 24 | valve body |
| 26 | valve port | 28 | reciprocating driver |
| 30 | connector | 32 | pin |
| 34 | valve body | 36 | valve port |
| 38 | blade | 40 | intake port |
| 42 | exhaust port | 44 | channel |

DETAILED DESCRIPTION OF THE INVENTION

The present invention can be applied to virtually any type of internal combustion engine. Those skilled in the art will know that most such engines employ 4 or more cylinders. However, in order to convey the principles of the present invention in an uncluttered manner, a single cylinder engine is illustrated. Many conventional components of such an engine have likewise not been illustrated.

Figure 1:
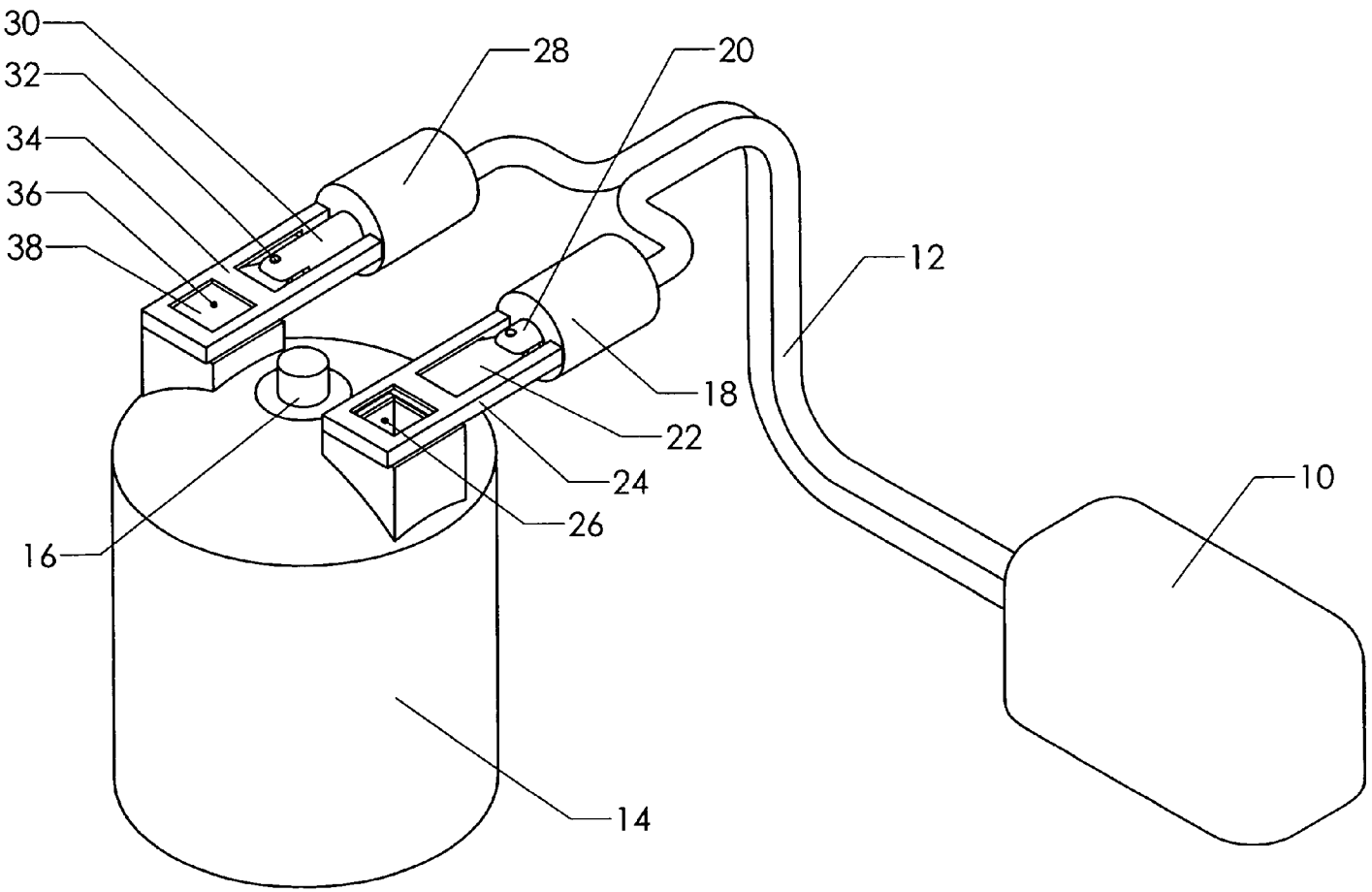
FIG. 1 is a perspective view, illustrating the present invention.

FIG. 1 illustrates a single-cylinder internal combustion engine employing guillotine sliding valves. Combustion chamber 14 is equipped with two guillotine sliding valves—one regulating the flow of fluid from the atmosphere through the intake port of combustion chamber 14 and one regulating the flow of fluid from the interior of combustion chamber 14 to the atmosphere through the exhaust port of combustion chamber 14. Combustion chamber 14 represents a single "cylinder" of a traditional four-stroke internal combustion engine. In the embodiment illustrated, two guillotine sliding valves (one for intake and one for exhaust) are provided on each cylinder of the internal combustion engine. Those skilled in the art will know that additional intake and exhaust valves could be provided using the same components.

FIG. 1 illustrates combustion chamber 14 during the intake stroke. Valve body 24 which houses blade 22 is attached to the intake port of combustion chamber 14. Blade 22 reciprocates within valve body 24 under the control of reciprocating driver 18. The reciprocating driver can assume many forms. In this embodiment, it comprises a fast-acting solenoid which is electrically energized via one of the cables 12. The reciprocating driver can be a single-acting solenoid with a return spring, or a pair of opposing solenoids with the motion being controlled by electrical energy during the opening and closing cycle. This approach has the advantage of being directly controlled by an electronic engine control unit ("ECU"). The ECU provides low-power control signals which can then be amplified to power the solenoid(s).

Other forms of energy could also be used to actuate the reciprocating driver. As a second example, a hydraulic cylinder could be used to propel connector 20 in one or more directions. The hydraulic cylinder would be one part of a hydraulic circuit which would selectively connect reciprocating driver 18 to a high pressure hydraulic line. The selective connection could be made using a solenoid to open and close a valve. Thus, this second type of system can also be easily controlled by the ECU.

Returning to the example of FIG. 1, powertrain control module 10 applies a voltage to cable 12 causing reciprocating driver 18 to retract connector 20 and blade 22 within valve body 24. This opens valve port 26 and allows intake air to be drawn from the intake manifold (not shown) through valve port 26 into combustion chamber 14 as the piston is drawn from top dead center to bottom dead center.

Valve body 34 is attached to the exhaust port of combustion chamber 14. Valve body 34 controls the exhaust flow from combustion chamber 14 to the exhaust header of the engine. During the intake stroke, no voltage is applied to reciprocating driver 28. As such, connector 30 and blade 38 remain in the fully extended position within valve body 34. Blade 38 thus blocks valve port 36 preventing exhaust gases from leaking back into combustion chamber 14 as the piston exerts a vacuum in combustion chamber 14 during the intake stroke.

Figure 2:
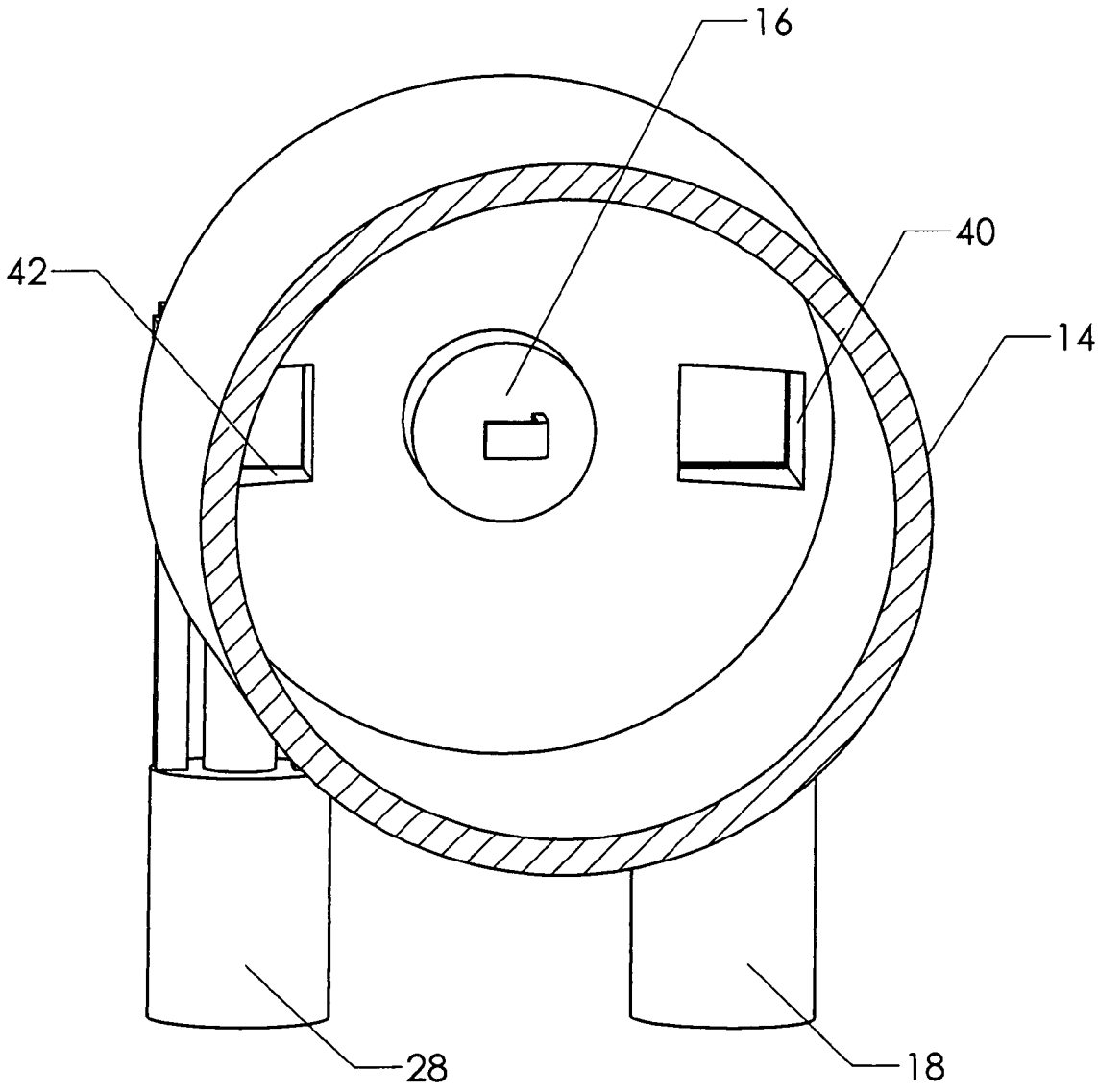
FIG. 2 is sectioned perspective view, illustrating the present invention.

Turning to FIG. 2, the interior of combustion chamber 14 is shown. The piston, connecting rod, crankshaft, and other conventional components are not illustrated. Spark plug 16 is situated at the top of the combustion chamber between intake port 40 and exhaust port 42. Although not shown in FIG. 1, spark plug 16 is also energized at the control of powertrain control module 10. Those that are skilled in the art know that an ignition coil is typically used to generate the high voltage required to create the spark from spark plug 16.

Figure 3:
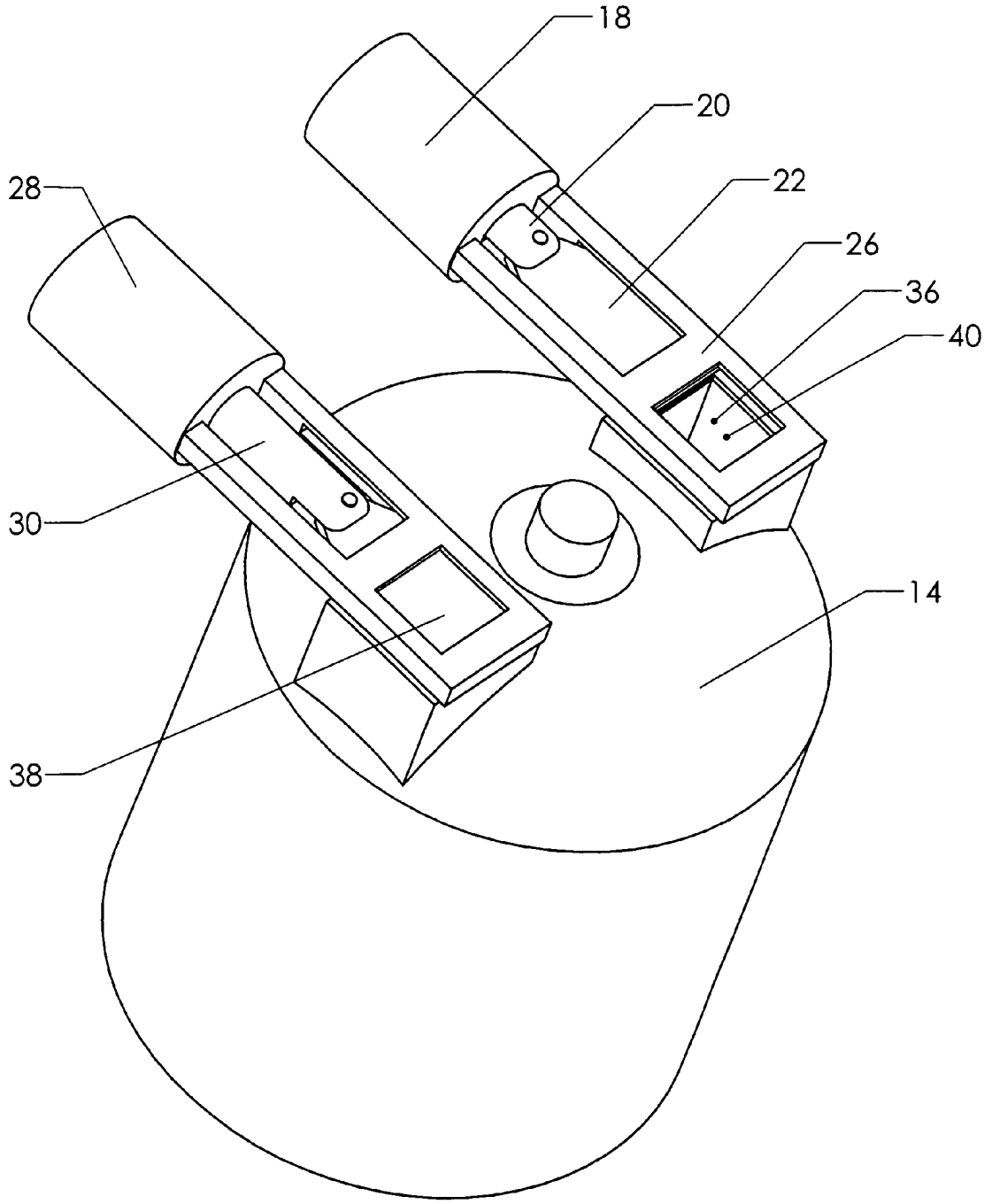
FIG. 3 is a perspective view, illustrating the present invention.

As shown more clearly in FIG. 3, the guillotine sliding valves control the flow of air in and out of the combustion chamber through the intake and exhaust ports. When reciprocating driver 18 retracts blade 22, valve port 36 is opened allowing intake air to pass from the intake manifold through valve body 26 and intake port 40 into combustion chamber 14.

Figure 4:
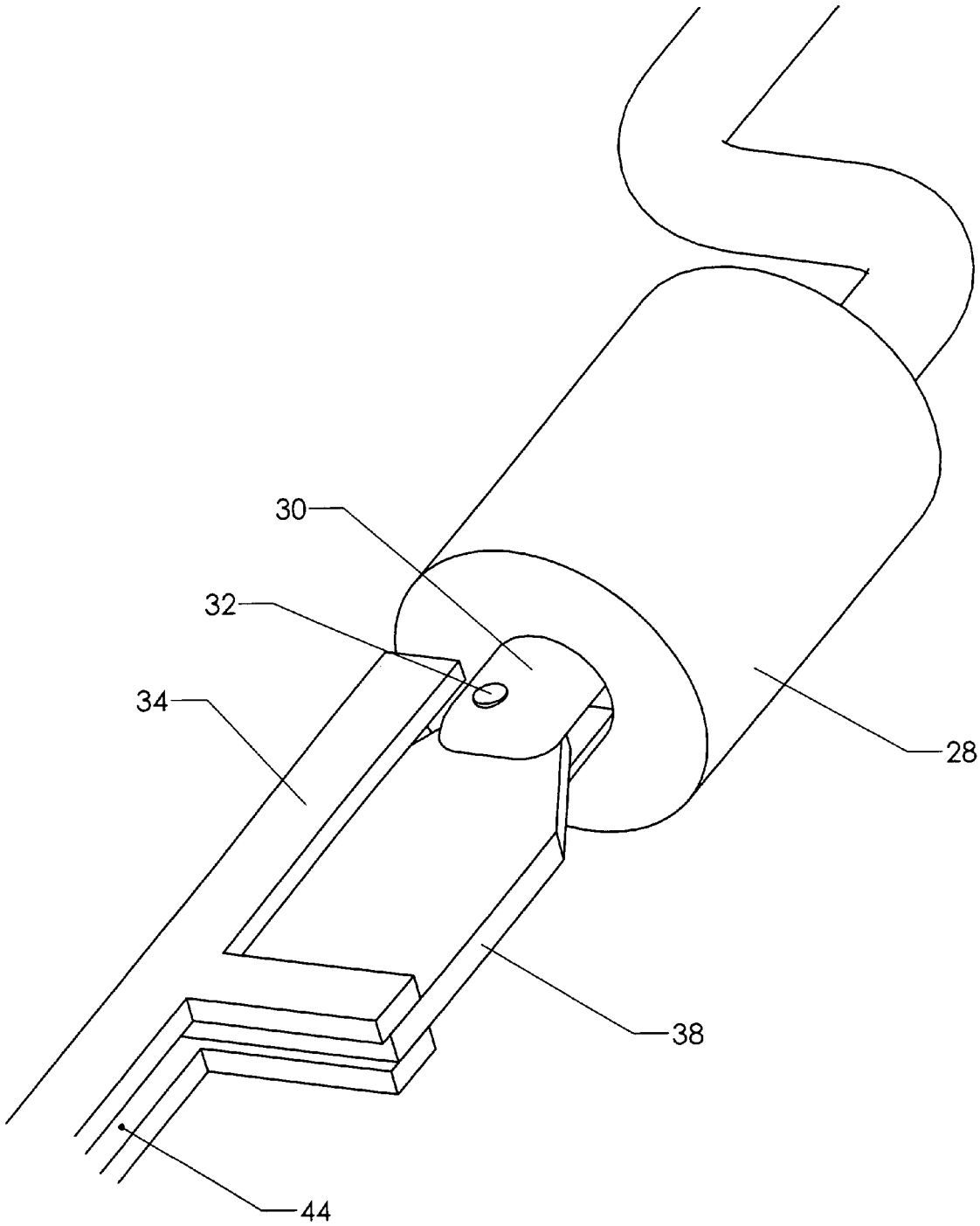
FIG. 4 is a sectioned perspective view, illustrating the present invention.

FIG. 4 is a detail view of the guillotine sliding valve with the near side of valve body 34 being cut away to reveal internal details. This valve controls the flow of gas between combustion chamber 14 and the engine's exhaust manifold. In FIG. 4, the valve is shown in the "open" position. The reader will note that reciprocating driver 28 has moved connector 30 from the extended position (shown in FIG. 1) to a retracted position. Blade 38 is attached to connector 30 by pin 32. Blade 38 moves within channel 44 of valve body 34 when reciprocating driver 28 moves connector 30. Channel 44 therefore acts as a blade track to guide blade 38 as it moves between the closed an opened position. As such, blade 38 moves in a direction perpendicular to the direction of travel of the piston and thus perpendicular to the direction of the vacuum and expansion forces created in combustion chamber 14 during the combustion cycle. Because of this arrangement, reciprocating drivers 18 and 28 require only a minimal amount of power to operate (since they are not opening or closing in a direction which is parallel to the flow). Those that are skilled in the art know that this is an essential requirement for any performance or fuel economy advantages to be realized by such a valve configuration.

Although FIGS. 1-3 illustrate the present invention during the intake stroke, those that are skilled in the art will now appreciate how powertrain control module 10 may be configured to control the opening and closing of the sliding guillotine valves throughout the entirety of the combustion cycle. As previously described, powertrain control module 10 opens blade 22 and closes blade 38 during the intake stroke. Both blade 22 and blade 38 are then maintained in the closed position during the compression stroke (when the piston travels from bottom dead center to top dead center) and the power stroke (when the piston travels from top dead center to bottom dead center after ignition). Powertrain control module 10 then opens blade 38 and closes blade 22 during the exhaust stroke (when the piston travels from bottom dead center to top dead center immediately following the power stroke).

With the general operating principles now described, the advantages offered by such a configuration may now be considered in greater detail. As mentioned previously, such a valve configuration is advantageous for optimizing performance and/or fuel economy. This is because the valve configuration of the present invention allows for nearly infinite control and variation of valve timing, lift and duration.

Most modern vehicles utilize fuel and ignition "maps" which are stored in the memory of the vehicle's engine control unit to control the amount of fuel injected into each combustion chamber as well as the timing of the ignition spark. These quantity and timing values are typically a function of engine speed (in revolutions per minute) and load (commonly based on throttle position, intake air flow rates measured by a mass air flow sensor, or both). The vehicle's engine control unit reads the engine speed and load and then looks up the quantity of fuel to inject (usually expressed in terms of fuel injector activation time) and the timing of spark (usually correlating to the position of the piston relative to top dead center during the compression or power stroke). These fuel maps can typically be modified or "tuned" for improved performance or fuel economy.

In much the same way that an engine control unit is able to read maps and control fuel and spark, it is contemplated that powertrain control module 10 may be configured to read maps and control valve timing, lift, and duration. As mentioned previously, valve timing, lift and duration have historically been modified by changing parts of the engine's valvetrain (for example, changing the camshaft, valves, valve springs, retainers, rocker arms, and shafts). Such is not required for the present invention. The "valvetrain" of the present invention may be easily modified by changing the maps powertrain control module 10 uses for controlling timing, lift, and duration. It should be noted that the term "lift" as used in the context of the present invention does not refer to the degree of separation of the poppet valve from the valve seat. Instead, "lift" refers to the analogous degree of opening of the guillotine sliding valve of the present invention. In the context of the present invention, "lift" may be controlled by the voltage value applied to reciprocating drivers 18 and 28. Higher voltages result in more lift (assuming a normally closed valve is used) or vice versa (assuming a normally open valve is used. Timing and duration are also controlled electronically based on the actual time and length of time voltage is applied to reciprocating drivers 18 and 28 relative to the combustion cycle.

As with fuel and spark maps, the proposed valve maps may also be engine speed and load dependant. As such, when the engine control unit reads the engine speed and load data, the same values may be used by powertrain control module 10 to look up the programmed values for valve timing, lift, and duration. It is further contemplated that various selectable map packs may be provided for the user so that the user may select a desired map for a particular application. For example, the user may select a map that is optimized for fuel economy before driving a long trip. Alternatively, the user may select a map pack that is optimized for performance before driving on a track.

The use of the guillotine valve also makes it possible to selectively open additional intake and exhaust valves. Those skilled in the art will know that engines achieve higher power outputs by using multiple intake and exhaust valves per cylinder (such as a pair of intake valves and a pair of exhaust valves). However, the use of both valve pair is relatively inefficient at low engine speeds. Thus, there are advantages to being able to selectively turn on and off one or more valves in a set. The guillotine valve allows this functionality.

There are many other advantages that may be realized with the guillotine sliding valve valvetrain of the present invention. Because the present invention can accomplish infinite valve timing, lift and duration by simple electronic control, there is no need for traditional valvetrain components (including camshafts and rocker arms). The removal of these components reduces engine weight, complexity, and cost. The control variability afforded by the present invention not only allows for optimized valve tuning based on load and engine speed, but also enables optimized valve tuning based on the fuel source. This feature may become more valuable as refueling stations continue to offer different ethanol and gasoline blends.

The reader should appreciate that the drawings show a relatively simplified embodiment of the invention. Many conventionally understood components—such as encapsulating housings with associated oil feedings and drainage ports—have not been illustrated. The present invention would preferably include such components.

The preceding description contains significant detail regarding the novel aspects of the present invention. It should not be construed, however, as limiting the scope of the invention but rather as providing illustrations of the preferred embodiments of the invention. Such variations would not alter the function of the invention. Thus, the scope of the invention should be fixed by the following claims, rather than by the examples given.

Having described my invention, I claim:

1. An internal combustion engine comprising:

a. a combustion chamber having a hollow interior with a first end and a second end, and a reciprocating piston moveable therein, said reciprocating piston moving along a fist reciprocating line of travel;

b. a valve regulating, the passage of a fluid between the hollow interior of the combustion chamber and the atmosphere, said valve including i. a valve body having a valve opening and a blade track passing around said valve opening, ii. a guillotine blade configured to slide along a second reciprocating line of travel within said blade track between an open position in which said fluid may pass through said valve opening and a closed position in which said fluid is restricted from passing through said valve opening;

iii. a reciprocating driver configured to move said guillotine blade along said blade track between said open position and said closed position;

c. said guillotine blade being driven between said open position and said closed position by an electrically-driven force, d. said electrically-driven force being controlled by an electronic control signal; and e. said electronic control signal being generated by an electronic engine control unit, with said electronic control signal being varied in response to variations in operating conditions of said internal combustion engine.

2. The internal combustion engine of claim 1, wherein said second reciprocating line of travel is substantially perpendicular to said first reciprocating line of travel.

3. The internal combustion engine of claim 1, wherein the length of time said guillotine blade remains in said open position varies as a function of engine speed.

4. The internal combustion engine of claim 1, wherein the length of time said guillotine blade remains in said open position varies as a function of engine load.

5. The internal combustion engine of claim 1, wherein the timing in which said guillotine blade moves to said open position varies as a function of engine speed.

6. The internal combustion engine of claim 1, wherein the timing in which said guillotine blade moves to said open position varies as a function of engine load.

7. The internal combustion engine of claim 1, wherein the crank angle degree in which said guillotine blade moves between said closed to said open position varies as a function of engine speed.

8. The internal combustion engine of claim 1, wherein the crank angle degree in which said guillotine blade moves between said closed to said open position varies as a function of engine load.

9. The internal combustion engine of claim 1, wherein said reciprocating driver moves said guillotine blade between said open position and said closed position when a voltage is applied to said reciprocating driver.

10. The internal combustion engine of claim 1, wherein the length of time said guillotine blade remains in said open position is controlled by an engine control module.

11. The internal combustion engine of claim 1, wherein the timing in which said guillotine blade moves to said open position is controlled by an engine control module.

12. The internal combustion engine of claim 1, wherein the crank angle degree in which said guillotine blade moves between said closed to said open position is controlled by an engine control module.

13. The internal combustion engine of claim 1, wherein the crank angle degree in which said guillotine blade moves between said closed to said open and the length of time said guillotine blade remains in said open position are each controlled electronically.

14. The internal combustion engine of claim 10, wherein said engine control unit references a valve map to determine said length of time said guillotine blade remains in said open position.

15. The internal combustion engine of claim 11, wherein said engine control unit references a valve map to determine said crank angle degree in which said guillotine blade moves to said open position.

16. The internal combustion engine of claim 12, wherein said engine control unit references a valve map to determine said crank angle degree in which said guillotine blade moves to said open position.

17. The internal combustion engine of claim 14, wherein said valve map provides a value for said length of time said guillotine blade remains in said open position as a function of engine speed.

18. The internal combustion engine of claim 15, wherein said valve map provides a value for said length of time said guillotine blade remains in said open position as a function of engine speed.

19. The internal combustion engine of claim 16, wherein said valve map provides a value for said length of time said guillotine blade remains in said open position as a function of engine speed.

* * * * *